United States Patent [19]

Grisham, Jr.

[11] 4,191,631

[45] Mar. 4, 1980

[54] DEWAXING PROCESS

[75] Inventor: William P. Grisham, Jr., Pasadena, Tex.

[73] Assignee: Shell Oil Company, Houston, Tex.

[21] Appl. No.: 881,283

[22] Filed: Feb. 27, 1978

[51] Int. Cl.[2] ..... C10G 43/08

[52] U.S. Cl. ..... 208/33

[58] Field of Search ..... 208/33

[56] References Cited

U.S. PATENT DOCUMENTS 3,720,599 3/1973 Gould ..... 208/33

FOREIGN PATENT DOCUMENTS 1145427 3/1969 United Kingdom .

*Primary Examiner*—Delbert E. Gantz
*Assistant Examiner*—Wayne A. Langel
*Attorney, Agent, or Firm*—Albert J. Adamcik

[57] ABSTRACT

A process for the solvent dewaxing of wax-containing oils is disclosed. The process is characterized by the use of certain crystal modifiers in conjunction with an apportionment of the oil feedstock to provide an initial solvent to oil ratio of three or greater.

16 Claims, No Drawings

DEWAXING PROCESS

BACKGROUND OF THE INVENTION

Dewaxing is one of the more important processes used in the refining of hydrocarbon oils, since removal of the wax results in an oil of markedly improved pour point. The process is usually carried out by chilling the oil to a sufficiently low temperature in order to precipitate the wax, and then filtering the wax from the oil. It is common practice to add to the oil solvents which tend to dissolve the oil and precipitate the wax. After the waxy constituents of the oils have precipitated, there is a marked tendency for the wax crystals to block the filters during the subsequent filtration step. This blockage considerably increases the time of filtration and also the amount of oil trapped in the wax cake.

United Kingdom patent No. 1,145,427, complete specification published Mar. 12, 1969, and whose disclosure is incorporated herein by reference, discloses that the above-described dewaxing process can be considerably improved by precipitating the wax in the presence of a polyalkyl acrylate of which the average number of carbon atoms in the alkyl side chains is at least 14. The presence of only small amounts of these polyalkyl acrylates is sufficient to improve the filtration rate.

Further work indicates that at least one of the polyalkyl acrylates appears to need a solvent to oil ratio of three or greater at the point of incipient crystallization. Where a single dilution of charge with solvent is employed, this ratio may be reached. However, where multiple dilutions are employed, i.e., multiple stages with incremental quantities of solvent added during chilling in each stage, even though the total solvent employed is supplied in a ratio of three or greater, it is unlikely that the ratio of solvent to oil at the onset of crystallization reaches three. For example, in one process employing six dilution stages, the highest dilution ratio employed in a given dilution stage is 0.9. A need has existed, therefore, for some modification of multiple dilution procedures which would allow the use of the polyalkyl acrylate modifiers and provide the benefits accruing from their use. The invention satifies that need.

SUMMARY OF THE INVENTION

Accordingly, the invention, in one embodiment, comprises an improvement of the continuous process of multiple dilution dewaxing of wax-containing oils. Briefly, the improvement comprises, in such multiple stage chilling processes, the use of a specific polyalkyl acrylate crystal modifier and the apportionment continuously of the feed in two portions to the chilling zones or stages. In one embodiment of this continuous staged process, a fraction of the initial feed is supplied to give a solvent to oil ratio of three or greater, the solvent being added and the mixture heated to a suitable temperature for dewaxing. The mixture is then passed and cooled in a first chilling zone or stage to a temperature below the temperature of incipient crystallization or the cloud point of the mixture, and the remaining feed, in the molten or liquid state, is mixed with the slurry. In this embodiment, the mixture is normally chilled further, and the process may then be continued as in conventional multiple dilution dewaxing. In another embodiment of the invention, it has also been found unexpectedly that apportionment of the feed charge in certain single dilution dewaxing processes provides unique advantages. Thus, in the single dilution scheme the feedstock, preferably containing the crystal modifier before apportionment, is apportioned into portions, and a portion is fed continuously and contacted with the full volume of solvent. After heating, the mixture is then passed and cooled to the point of incipient crystallization or cloud point, and the remaining portion of feed is continuously added. The feed-solvent mixture may then be continuously processed as in conventional single dilution dewaxing processes. It is important that the temperature of the combined feed-solvent, feed mixture be below that of incipient crystallization, or the cloud point. At the same time, the temperature after recombination must not be so low as to promote bulk precipitation. In general, the temperature of the recombined streams should not be lower than about 20 to 30 degrees lower than the temperature of incipient crystallization. The cloud point or temperature of incipient crystallization of a given feed can be routinely determined, and it is well within the skill of the art to adjust temperatures to the appropriate levels in these processes. Single and multiple dilution processes for the dewaxing of wax-containing oils are known per se, and form no part of the present invention. For example, see Hydrocarbon Processing, September 1970, page 246.

The division or apportionment of the feed charge in the manner described, with the concomitant use of the modifier employed, as indicated, provides unexpected advantages. For example, with certain bright stocks, substantial decreases in filtration time accrue in a multiple dilution scheme, and the yields of dewaxed oil are higher. Similar advantages accrue in a single dilution scheme. In general, the fraction of the total feed sent through the first chilling stage of a multiple dilution scheme will be 0.2 to 0.7, (20 to 70 percent by volume) with a feed fraction of 0.3 to 0.6 (30 to 60 percent by volume) being preferred. The balance of the feed is then added, as indicated. In a single dilution process, the feed portions are similar, the second portion being added continuously after the temperature of incipient crystallization is reached. In both single dilution and multiple dilution processes, this may be accomplished simply by continuously splitting the feed and sending one portion as a continuous stream to the chilling zone where the solvent-feed mixture has reached the temperature of incipient crystallization. In one case, for example, this will mean addition of the feed fraction in the first chilling zone at some point spaced from the feed-solvent entry into the zone, so that the addition is made to the stream which is in a condition of incipient crystallization.

The polyalkyl acrylates employed are those described in United Kingdom patent No. 1,145,427, i.e. polyalkyl acrylates in which the average number of carbon atoms in the alkyl side chains is at least 14. Preferred are polyalkyl acrylates wherein the long alkyl side chains contain the group $CH_3—(CH_2)_n—CH_2—$, in which n is greater than 12. Polyalkyl acrylates whose average number of carbon atoms in the alkyl side chains is at least 16 and at most 26 are preferred. A most preferred polyalkyl acrylate is one in which the average number of carbon atoms in the alkyl side chains is 20. This polyalkyl acrylate, known in the art as Shellswim-5, is a poly n- $C_{20}$ average alkyl acrylate (wt. average mol. wt.=220,000; no. average mol. wt.=60,000) in which the alkyl is 45% $C_{18}$, 10% $C_{20}$, and 45% $C_{22}$.

The polyalkyl acrylates to be employed in the present process may be prepared in any suitable way for the polymerization of alkyl acrylates. The polymers may be either homopolymers or copolymers. If the polyalkyl acrylates are homopolymers, the starting material is one specific alkyl acrylate with at least 14 carbon atoms in the alkyl group. If the polyalkyl acrylates are copolymers, the starting material is a mixture of alkyl acrylates which in addition to one specific alkyl acrylate with at least 14 carbon atoms in the alkyl group contains one or more other alkyl acrylates which may or may not have at least 14 carbon atoms in the alkyl groups. As examples of alkyl acrylates having at least 14 carbon atoms in the alkyl group and being suitable for the preparation of homo- or copolymers which may be applied according to the invention may be mentioned: n-tetradecyl acrylate, n-hexadecyl acrylate, n-octadecyl acrylate, n-eicosyl acrylate, n-docosyl acrylate, n-tetracosyl acrylate and n-hexacosyl acrylate. As examples of alkyl acrylates having less than 14 carbon atoms in the alkyl groups and being suitable for the preparation of copolymers which may be applied according to the invention may be mentioned: methyl acrylate, ethyl acrylate, butyl acrylate and hexyl acrylate, ethyl acrylate, butyl acrylate and hexyl acrylate. If the polyalkyl acrylates to be employed according to the invention are copolymers, preference is given to copolymers of two or more alkyl acrylates, each having at least 14 carbon atoms in the alkyl group. The homopolymers of n-hexadecyl acrylates, n-octadecyl acrylate and n-eicosyl acrylate are preferred.

The molecular weight of the polymers may vary between wide limits. For application in practice it is preferable to choose polymers whose average molecular weight (number of average $M_n$) ranges between 1,000 and 1,000,000, in particular between 4,000 and 100,000. An effective amount of the polyalkyl acrylate, i.e., an amount effective to provide the advantages sought, in conjunction with the apportionment of the feed mentioned, will be employed. This amount may be determined by experimentation, and may vary, depending on the type of hydrocarbon oil being dewaxed. The preferred range is 0.01 to 0.4% by weight of oil. The modifier is preferably added with the incoming feed, although it may be added to the portions after separation.

The present dewaxing process may be applied to a great variety of wax-containing high wax content petroleum oils. The invention is especially of importance for the dewaxing of oils such as short residues which remain as a bottom product from topped crude oils from which all lighter fractions down to and including distillate oil fractions have been removed. Very suitable are waxy raffinates produced from residual or distillate petroleum oils by the extraction of aromatics. Specific feedstocks which are suitable include bright stocks such as Basrah, East Texas/Louisiana, Kirkuk and Qatar Marine bright stocks.

As mentioned before, the precipitation of wax from the hydrocarbon oil is suitably effected by chilling the oil in the presence of a dewaxing solvent. Such solvents tend to dissolve the oil and precipitate the wax. Examples of solvents which can be used for this purpose are ketones such as methyl ethyl ketone and acetone and mixtures of them with an aromatic solvent such as benzene or toluene. Particularly preferred as a dewaxing solvent is a mixture of methyl ethyl ketone and toluene. The latter mixture may vary in composition, e.g. from 70 percent (by volume) to 40 percent of methyl ethyl ketone. A mixture containing from 60 percent (by volume) to 40 percent methyl ethyl ketone is preferred. In multiple dilution processes, the composition of the solvent, as well as the amounts added, may vary from stage to stage, as is known in art. The terms "zone", "zones, or "stages", as used herein in relation to chilling, are not meant merely to imply single pieces of equipment, but are to be considered to include one or more units which have the function of lowering the temperature a desired amount. Thus, for example, included in the first "zone" of a given continuous multiple dilution process may be one or more heat exchangers of differing types.

The oil treated and the solvent employed will normally be heated before chilling. In the case of methyl ethyl ketone and residual petroleum oils, heating of the feed to a temperature of above about 170° F. is desirable.

The invention is particularly applicable to single or multiple dilution dewaxing procedures utilizing the aforementioned solvents. The invention is especially applicable to that continuous process, of the type described, in which the solvent-oil mixture is heated to above 170° F., the mixture is then cooled in a first chilling zone or stage to a temperature below the cloud point of the mixture, or below the point of incipient crystallization, the remaining solvent is added in portions in succeeding chilling zones stages, preferably four to six, each zone or stage being progressively cooler, and the wax slurry is filtered. A typical multiple dilution operation is to introduce the feed oil and solvent continuously, after heating, into the initial chilling zone at a temperature of about 160° F. to 170° F.; to operate the second chilling zone or stage at an inlet temperature of about 80° F.; to operate the third chilling stage at an inlet temperature of about 60° F.; to introduce the mixture to the fourth chilling stage at a temperature of about 45° F.; to introduce the mixture to the fifth chilling stage at about 12° F., and to chill the same in the sixth chilling zone or stage to a filtering temperature of about +5° F. The number of the respective chilling zones or stages as well as their arrangement may be varied appreciably and a variety of chilling means may be utilized. For purposes of this illustration it is assumed that the solvent comprises methyl-ethyl ketone and toluene. It is also assumed that about 2.5 to 3 volumes of total solvent mixture is utilized per volume of waxy oil being dewaxed. The solvent mixture comprises from 65 to 70 percent by volume of methyl-ethyl ketone in the first two chilling zones, and 46 to 64 percent methyl-ethyl ketone in the remaining stages or zones. Application of the invention to single dilution processes is preferred.

Illustrative Embodiments

Laboratory experiments were carried out in batch, bench-scale dewaxing/deoiling equipment. The crystallizer was a modified ice cream freezer, immersed in a coolant bath. The vessel was 4.9 inches I.D.×9 inches and was fitted with a counter-rotating scraper. The vessel and scraper each rotated at 28 rpm. The chilling rate in these studies was 3 F/minute, controlled by a Foxboro temperature programmer which circulated cold acetone through a coil in the crystallizer bath. Multiple dilutions with solvent were made during the cooling sequence by halting the stirring momentarily and adding the appropriate amount of solvent.

The filter was a Buechner-type funnel, fitted with cotton filter cloth and immersed in a second thermostatted bath. The surface area was 0.55 $ft^2$. The degree of vacuum used in these studies was 15 inches Hg. The filtrates were stripped free of solvent in conventional glass stills. The final stripping conditions were 350° F. kettle temperature and 22 inches Hg vacuum, with a small nitrogen purge.

The general procedure used was as follows. A fraction of the waxy charge was dissolved in the initial dilution solvent at 165°–170° F., in the crystallizer. The crystallizer is transferred to the chilling bath which is at 165°–170° F. The slurry is chilled at 3° F./minute to the filtration temperature, with subsequent additions of solvent made at the appropriate temperatures. The remainder of the feed was added after the cloud point was reached. When the filtration temperature was reached, the slurry was poured onto the filter. Vacuum was applied and the filter time was measured with an electric timer connected to the vacuum solenoid valve. After the primary filtration, the wax cake was washed with additional prechilled solvent. In dewaxing experiments, where repulping was not applied, the cake was removed from the filter and solvent stripped, and the filtrate was also stripped of solvent.

The fraction of initial feed was chosen to give ≧3.0 solvent/oil in the initial crystallization. A part or all of the crystal modifier was contained in the initial feed. This mixture was heated to the usual 160°–170° F. temperature to effect complete solution and then cooled to below the cloud point of the system. At this point, the remaining feed, in the molten state, was injected into the slurry. The resultant mixture was then chilled down to the filtration temperature, with multiple solvent dilutions made at the appropriate injection points.

The experimental conditions and the results are given in Table 1. This technique of incremental feed addition is effective with East Texas/Louisiana bright stock, and substantial decreases in filtration times accrue. In addition, the yields of dewaxed oil are higher, reducing the loss of saleable oil to soft wax during deoiling.

TABLE 1

DEWAXING HOUSTON BRIGHT STOCK WITH SECONDARY ADDITION OF FEED

Common Experimental Conditions:
Charge Wt.: 200 gms
Final Solvent/Oil*: 3.0
Wash Ratio*: 1.0
Solvent: 50% v MEK/50% v Toluene
ADDITIVE: POLYALKYL ACRYLATE $C_{20}$ average side chains (SHELLSWIM-5)
*Ratio Basis Total Feed

| | Solvent Dilution S/O* | Solvent Dilution Temp. °F. |
|---|---|---|
| 1st Injection | 0.5 | 80 |
| 2nd Injection | 0.5 | 45 |
| 3rd Injection | 0.5 | 20 |

| Run No., LM- | 408 | 406 | 407 | 409 | 410 | 412 |
|---|---|---|---|---|---|---|
| Additive | | | | | | |
| ppm, Basis Total Feed | 0 | 750 | 375 | 375 | 375 | 375 |
| Initial Dilution | | | | | | |
| Initla/Total Feed | 0.5 | 0.5 | 0.4 | 0.4 | 0.4 | 0.4 |
| Solvent/oil[1] | 3.0 | 3.0 | 3.0 | 3.75 | 3.75 | 3.75 |
| ppm Additive[1] | — | 1500 | 750 | 940 | 940 | 940 |
| Feed Injection | | | | | | |
| Final/Total Feed | 0.5 | 0.5 | 0.5 | 0.6 | 0.6 | 0.6 |
| Solvent/Oil[2] | ←No Solvent or Additive in Final Feed→ | | | | | |
| ppm Additive | | | | | | |
| Injection Temp., °F. | 100 | 100 | 100 | 100 | 80 | 110 |
| Filtration | | | | | | |
| Filt. Temp., °F. | +5 | +5 | +5 | +5 | +5 | 0 |
| Filt. Time, Sec. | 33 | 23 | 22 | 22 | 54 | 16 |
| Wash Time, Sec. | 42 | 20 | 19 | 17 | 58 | 14 |
| Total Time, Sec. | 75 | 43 | 41 | 39 | 112 | 30 |
| Cake Thick., Inches | 0.30 | 0.18 | 0.17 | 0.15 | 0.25 | 0.15 |
| Recovery, % w | 94.7 | 92.8 | 98.4 | 98.5 | 96.5 | 97.5 |
| Dewaxed Oil, % w | 61 | 68 | 70 | 70 | 63 | 69 |
| Crude Wax, % w | 39 | 32 | 30 | 30 | 37 | 31 |
| Properties | | | | | | |
| Dewaxed Oil Pour Pt., °F. | 25 | 25 | 25 | 25 | — | 20 |
| Oil in Crude Wax, % w | 9.9 | 6.2 | 6.0 | 6.2 | — | 5.9 |

Common Experimental Conditions:
Charge Wt.: 200 gms
Final Solvent/Oil*: 3.0
Wash Ratio*: 1.0
Solvent: 50% v MEK/50% v Toluene
*Ratio Basis Total Feed
ADDITIVE: POLYALKYL ACRYLATE (SHELLSWIM-5)

| | Solvent Dilution S/O* | Solvent Dilution Temp. °F. |
|---|---|---|
| 1st Injection | 0.5 | 80 |
| 2nd Injection | 0.5 | 45 |
| 3rd Injection | 0.5 | 20 |

| Run No., LM- | 420 | 413 | 414 | 415 | 416 | 419 | 422 | 421 |
|---|---|---|---|---|---|---|---|---|
| Additive | | | | | | | | |
| ppm, Basis Total Feed | 375 | 375 | 375 | 200 | 100 | 200 | 200 | 100 |
| Initial Dilution | | | | | | | | |
| Initial/Total Feed | 0.75 | 0.6 | 0.33 | 0.33 | 0.33 | 0.33 | 0.33 | 0.33 |

TABLE 1-continued

| DEWAXING HOUSTON BRIGHT STOCK WITH SECONDARY ADDITION OF FEED | | | | | | | | |
|---|---|---|---|---|---|---|---|---|
| Solvent/Oil[1] | 2.0 | 2.5 | 4.5 | 4.5 | 4.5 | 3.75 | 3.75 | 3.75 |
| ppm Additive[1] | 500 | 625 | 1125 | 600 | 300 | 300 | 300 | 300 |
| Feed Injection | | | | | | | | |
| Final/Total Feed | 0.25 | 0.4 | 0.67 | 0.67 | 0.67 | 0.67 | 0.67 | 0.67 |
| Solvent Oil[2] | ( | No Solvent or Additive | | | ) | 0.38 | 0.38 | 0.38 |
| ppm Additive[2] | ( | in Final Feed | | | ) | 150 | 150 | 0 |
| Injection Temp., °F. | 110 | 110 | 110 | 110 | 110 | 110 | 110 | 110 |
| Filtration | | | | | | | | |
| Filt. Temp., °F. | 0 | 0 | 0 | 0 | 0 | 0 | 0 | 0 |
| Filt. Time, Sec. | 32 | 24 | 17 | 17 | 21 | 16 | 16 | 30 |
| Wash Time, Sec. | 35 | 21 | 15 | 14 | 18 | 12 | 13 | 30 |
| Total Time, Sec. | 67 | 45 | 32 | 31 | 39 | 28 | 29 | 60 |
| Cake Thick., Inches | 0.20 | 0.20 | 0.15 | 0.15 | 0.17 | 0.15 | 0.15 | 0.25 |
| Recovery, % w | 93.7 | 97.5 | 98.5 | 98.3 | 98.0 | 98.5 | 97.8 | 100.0 |
| Dewaxed Oil, % w | 68 | 69 | 70 | 71 | 70 | 71 | 71 | 67 |
| Crude Wax, % w | 32 | 31 | 30 | 29 | 30 | 29 | 29 | 33 |
| Properties | | | | | | | | |
| Dewaxed Oil Pour Pt., °F. | 20 | 20 | 20 | 20 | 20 | 20 | | |
| Oil in Crude | 6.7 | 5.8 | 5.4 | 5.5 | 6.1 | 5.5 | 6.7 | 10.0 |

[1]Basis Initial Feed
[2]Basis Final Feed

I claim as my invention:

1. In a continuous multiple dilution process for de-waxing a wax-containing petroleum oil wherein a wax-containing petroleum oil feed is contacted with a ketone de-waxing solvent in a series of progressively cooler chilling zones to precipitate wax and provide wax and a wax-depleted oil, the improvement comprising, carrying out the contacting of the wax-containing oil in the presence of an effective amount of a polyalkyl acrylate crystal modified, and continuously apportioning the feed to provide in the initial contacting a solvent-oil mixture having a solvent to oil feed ratio of three or greater, and adding the remaining portion of the feed to the solvent-oil mixture when the point of incipient crystallization of the solvent-oil mixture is reached.

2. The process of claim 1 wherein from 20 percent to 70 percent of the feed is contacted with the solvent initially.

3. The process of claim 2 wherein the solvent employed is a mixture of methyl ethyl ketone and toluene, the amount of methyl ethyl ketone being from 40 percent by volume to 70 percent by volume.

4. The method of claim 3 wherein the crystal modifier is a poly n-$C_{20}$ avg. alkyl acrylate (wt. avg. mo. wt.=220,000; no. avg. mol. wt.=50,000) in which the alkyl is 45% $C_{18}$, 10% $C_{20}$; 45% $C_{22}$.

5. The method of claim 4 wherein the solvent-oil mixture is heated before chilling.

6. A process for dewaxing a wax-containing petroleum oil comprising:

(a) apportioning a wax-containing oil feedstock into two portions;

(b) adding an effective amount of a polyalkyl acrylate crystal modifier to a first portion of the wax-containing oil;

(c) contacting the wax-containing, crystal modifier-containing oil portion with a ketone dewaxing solvent to produce a solvent-oil, crystal modifier-containing mixture having a solvent to oil ratio of three or greater;

(d) heating said solvent-oil crystal modifier-containing mixture;

(e) cooling the solvent-oil crystal modifier-containing mixture to below the point of incipient crystallization of the mixture;

(f) adding the second portion of the feedstock to the solvent-oil, crystal modifier-containing mixture to form a combined solvent-oil, wax slurry;

(g) cooling and adding additional solvent to said combined slurry in a series of progressively cooler chilling zones; and (h) separating the wax from the slurry.

7. The process of claim 6 wherein from 20 percent to 70 percent of the feed is contacted with the solvent initially.

8. The process of claim 7 wherein the solvent employed is a mixture of methy ethyl ketone and toluene, the amount of methyl ethyl ketone being from 40 percent by volume to 70 percent by volume.

9. The method of claim 8 wherein the crystal modifier is a poly n-$C_{20}$ avg. alkyl acrylate (wt. avg. mo. wt.=220,000; no. avg. mol. wt.=60,000) in which the alkyl is 45% $C_{18}$, 10% $C_{20}$, 45% $C_{22}$.

10. The method of claim 9 wherein the solvent-oil mixture is heated before chilling.

11. In a continuous single dilution process for dewaxing a wax-containing petroleum oil wherein a wax-containing oil feed is contacted with a ketone de-waxing solvent in a single dilution zone, and in the presence of an effective amount of a polyalkyl acrylate crystal modifier to provide a solvent-oil mixture and wherein the solvent-oil mixture is cooled in stages to precipitate wax and provide a wax-oil slurry, and the wax slurry is separated to provide a wax and a wax-depleted oil, the improvement comprising continuously apportioning the feed to provide in the contacting a solvent-oil mixture having a solvent to oil feed ratio of three or qreater, and adding the remaining portion of the feed to the solvent-oil mixture when the point of incipient crystallization of the solvent-oil mixture is reached.

12. The process of claim 11 wherein the solvent employed is a mixture of methyl ethyl ketone and toluene, the amount of methyl ethyl ketone being from 40 percent by volume to 70 percent by volume.

13. The method of claim 12 wherein the crystal modifier is a poly n-$C_{20}$ avg. alkyl acrylate (wt. avg. mo. wt.=220,000; no. avg. mol. wt.=60,000) in which the alkyl is 45% $C_{18}$, 10% $C_{20}$, 45% $C_{22}$.

14. The method of claim 13 wheren the solvent-oil mixture is heated before chilling.

15. A process for dewaxing a wax-containing petroleum oil comprising:

(a) adding an effective amount of a polyalkyl acrylate crystal modifier to a wax-containing oil;

(b) apportioning the wax-containing oil feedstock into two portions;

(c) contacting one portion of the wax-containing, crystal modifier-containing oil with a ketone dewaxing solvent to produce a solvent-oil, crystal modifier-containing mixture having a solvent to oil ratio of three or greater;

(d) heating said solvent-oil crystal modifier-containing mixture;

(e) cooling the solvent-oil crystal modifier-containing mixture to below the point of incipient crystallization;

(f) the adding the second portion of the feedstock to the solvent-oil, crystal modifier-containing mixture to form a combined solvent-oil, wax slurry;

(g) cooling and adding additional solvent to said combined slurry in a series of progressively cooler chilling zones; and (h) separating the wax from the slurry.

16. The process of claim 15 wherein from 20 percent to 70 percent of the feed is contacted with the solvent initially.

* * * * *